US008123534B1

(12) United States Patent
Herring et al.

(10) Patent No.: US 8,123,534 B1
(45) Date of Patent: Feb. 28, 2012

(54) MOUNTING FEATURES FOR STRADDLE MOUNT CONNECTORS

(75) Inventors: Michael David Herring, Apex, NC (US); Michael Allen Blanchfield, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/900,318

(22) Filed: Oct. 7, 2010

(51) Int. Cl.
*H01R 13/62* (2006.01)
*H01R 12/00* (2006.01)

(52) U.S. Cl. ..... 439/79; 439/328

(58) Field of Classification Search ..... 439/78, 439/79, 327, 328
See application file for complete search history.

(56) References Cited

U.S. PATENT DOCUMENTS 4,303,291 A 12/1981 Dines
5,261,989 A * 11/1993 Ueltzen ..... 156/252
5,415,573 A * 5/1995 Chen et al. ..... 439/876
5,472,349 A 12/1995 Dixon et al.
5,688,129 A 11/1997 Flaherty
5,893,764 A * 4/1999 Long ..... 439/79
6,077,093 A * 6/2000 Seong et al. ..... 439/79
6,341,988 B1 * 1/2002 Zhu et al. ..... 439/79
6,712,632 B2 * 3/2004 Wu ..... 439/328
6,736,651 B2 * 5/2004 Ho ..... 439/79
6,767,224 B2 7/2004 Wu
6,767,235 B2 * 7/2004 Wu ..... 439/328
7,112,072 B2 * 9/2006 Korsunsky et al. ..... 439/108
7,442,055 B2 * 10/2008 Robinette ..... 439/79
7,553,163 B2 6/2009 McAlonis et al.
7,670,151 B2 * 3/2010 Yang ..... 439/79
7,726,983 B2 * 6/2010 Zhu ..... 439/79
2002/0004337 A1 * 1/2002 Chiang ..... 439/607

* cited by examiner

*Primary Examiner* — Briggitte R Hammond

(57) ABSTRACT

A straddle mount connector includes a housing that has a mating end and a mounting end configured to be mounted to an edge of a circuit board. The housing has a top and a bottom. The housing has an upper mounting feature extending from the mounting end proximate to the top and a lower mounting feature extending from the mounting end proximate to the bottom. The upper and lower mounting features are configured to extend into an opening through the circuit board to secure the housing to the circuit board. Contacts are held by the housing and extend from the mounting end and are configured to be terminated to both sides of the circuit board. The contacts are arranged at the mating end and are configured for mating with a corresponding mating component.

20 Claims, 5 Drawing Sheets

MOUNTING FEATURES FOR STRADDLE MOUNT CONNECTORS

BACKGROUND OF THE INVENTION

The subject matter herein relates generally to circuit board connectors, and more particularly to mounting features for straddle mount connectors that are mounted to an edge of a circuit board.

One type of electrical connector used in today's electronic equipment is termed a "straddle mount connector" or "board edge connector". The electrical connector is provided for receiving a circuit board having a mating edge and a plurality of contact pads or conductors exposed adjacent the mating edge of the board. Typically, the electrical connector includes contacts having cantilevered spring arms which are biased against the contact pads on the circuit board. The contacts are soldered to the contact pads after the electrical connector is mounted to the circuit board. The electrical connector includes board mounting features extending outward therefrom that rest on the surface of the circuit board. The board mounting features have an opening therethrough that is aligned with an opening in the circuit board. A separate fastener passes through the opening in the board mounting feature and the circuit board to hold the electrical connector to the circuit board. In some applications, the electrical connector and the attached circuit board form a sub-assembly for a further device. One such use for the electrical connector is in the assembly of making memory cards or other electronic devices.

Known electrical connectors are not without disadvantages. For instance, there is a trend to increase the density of electrical connectors and other electronic components on the circuit board. The real estate of the circuit board is valuable. There is a desire to reduce the amount of space the electrical connectors and other electronic components require on the circuit board. Having bulky board mounting features requires additional space along the edge of the circuit board, reducing the total space allowed for mounting electrical connectors or other electronic components to the circuit board.

BRIEF DESCRIPTION OF THE INVENTION

In one embodiment, a straddle mount connector is provided having a housing that has a mating end and a mounting end configured to be mounted to an edge of a circuit board. The housing has a top and a bottom. The housing has an upper mounting feature extending from the mounting end proximate to the top and a lower mounting feature extending from the mounting end proximate to the bottom. The upper and lower mounting features are configured to extend into an opening through the circuit board to secure the housing to the circuit board. Contacts are held by the housing and extend from the mounting end and are configured to be terminated to both sides of the circuit board. The contacts are arranged at the mating end and are configured for mating with a corresponding mating component.

In a further embodiment, a connector system is provided with a circuit board that has a first surface and a second surface with pads on the first and second surfaces proximate to an edge of the circuit board. The edge extends in a longitudinal direction. The pads define a contact region of the circuit board. The circuit board has an opening that extends therethrough. The opening is longitudinally offset from the contact region. A straddle mount connector is mounted to the edge of the circuit board. The straddle mount connector has a housing having a mating end and a mounting end configured to be mounted to the edge of the circuit board. The housing is elongated in a longitudinal direction parallel to the mounting end and has a mounting feature that extends from the mounting end. The mounting feature is configured to extend into the opening through the circuit board to secure the housing to the circuit board. The mounting feature has a side that defines the longitudinally outermost portion of the straddle mount connector. The side is positioned inside of a longitudinally outermost point of the opening. Contacts are held by the housing and extend from the mounting end and are configured to be terminated to pads on both sides of the circuit board. The contacts are arranged at the mating end and are configured for mating with a corresponding mating component.

In another embodiment, a connector system is provided having a circuit board that has a first surface and a second surface with pads on the first and second surfaces proximate to an edge of the circuit board. The pads define a contact region of the circuit board. The circuit board has an opening extending therethrough. The opening has a centerline dividing the opening into an outer portion and an inner portion. The inner portion is positioned between the outer portion and the contact region. A straddle mount connector is mounted to the edge of the circuit board and includes a housing that has a mating end and a mounting end configured to be mounted to the edge of a circuit board. The housing has a mounting feature extending from the mounting end. The mounting feature is configured to extend into the inner portion of the opening through the circuit board to secure the housing to the circuit board. Contacts are held by the housing and extend from the mounting end and are configured to be terminated to pads on both sides of the circuit board. The contacts are arranged at the mating end and are configured for mating with a corresponding mating component.

DETAILED DESCRIPTION OF THE INVENTION

Figure 1:
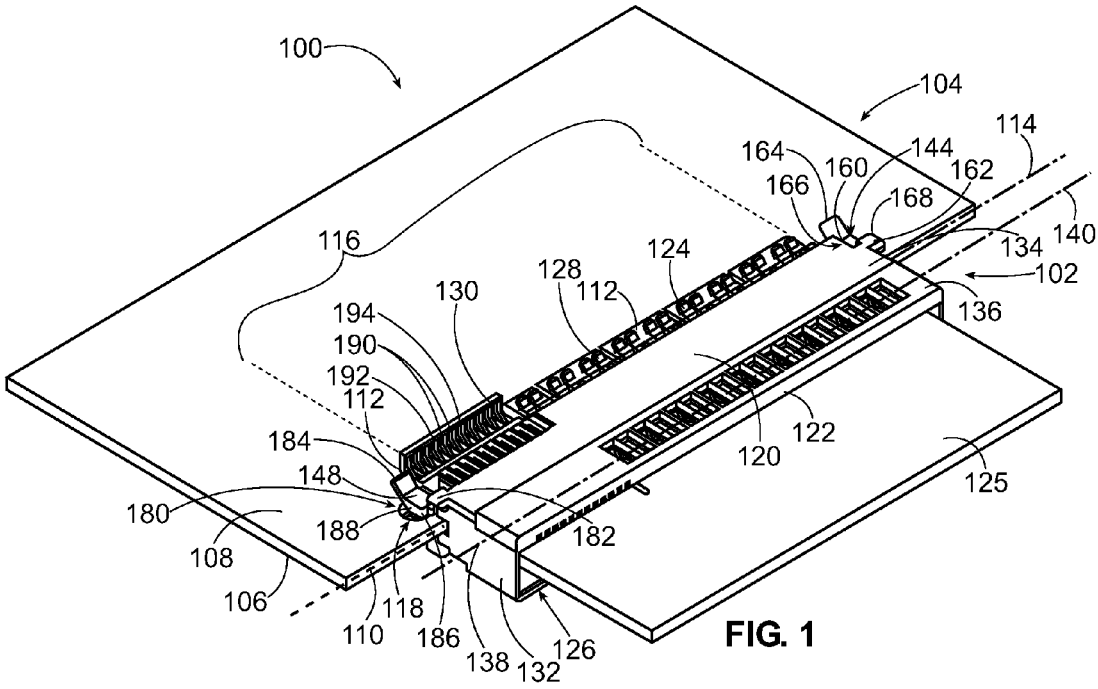
FIG. 1 is a bottom, front perspective view of a connector system formed in accordance with an exemplary embodiment showing a straddle mount connector mounted to a circuit board.
Figure 2:
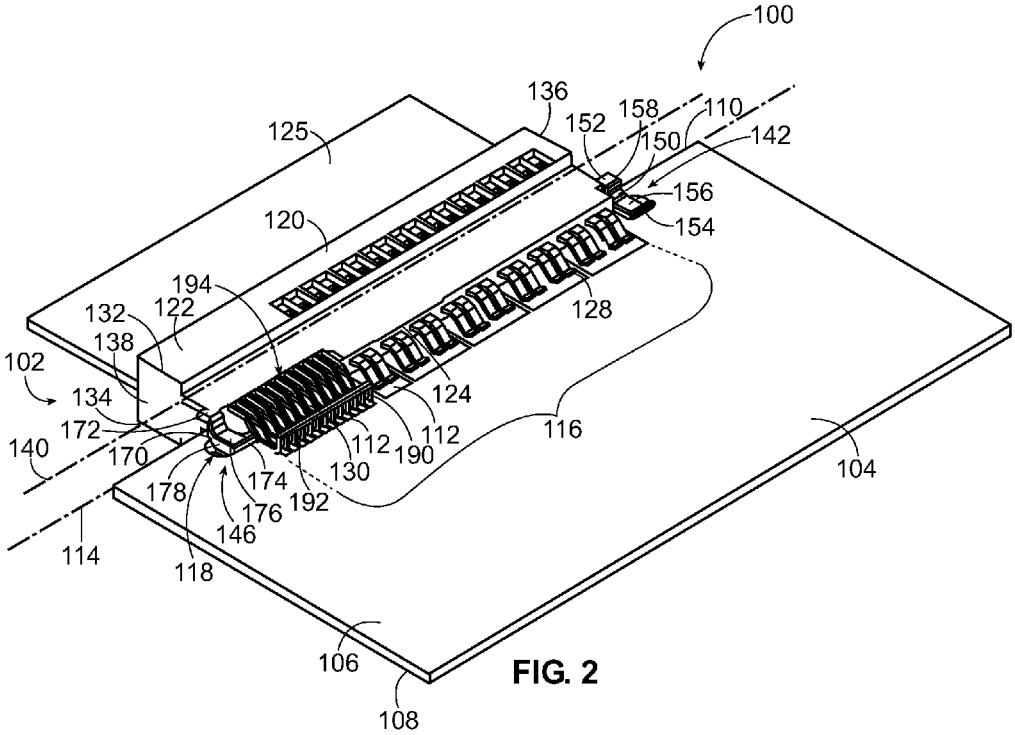
FIG. 2 is a top, rear perspective view of the connector system shown in FIG. 1.

FIG. 1 is a bottom, rear perspective view of a connector system 100 formed in accordance with an exemplary embodiment showing a straddle mount connector 102 mounted to a circuit board 104. FIG. 2 is a top, rear perspective view of the connector system 100. Electrical components (not shown), such as memory modules, processors and the like may also be mounted to the circuit board 104. Optionally, more than one straddle mount connector 102 may be mounted to the circuit board 104.

The circuit board 104 includes a first surface 106 and a second surface 108. The circuit board 104 has a mating edge 110 with a plurality of contact pads 112 on the first and second surfaces 106, 108 at the mating edge 110. The mating edge 110 extends longitudinally along a longitudinal axis 114. The contact pads 112 are arranged in a contact region 116 defined between openings 118 of the circuit board 104. The openings 118 define mounting features of the circuit board 104. The straddle mount connector 102 is mounted to the mating edge 110 of the circuit board 104 at the contact region 116 such that the straddle mount connector 102 is electrically connected to the contact pads 112. The contact pads 112 may be any type of pads, such as power pads, signal pads, ground pads and the like, where power is transmitted through the power pads, data signals are transmitted through the signal pads, and the ground pads are electrically commoned with a ground plane of the circuit board 104.

The straddle mount connector 102 engages the openings 118 for securely coupling the straddle mount connector 102 to the circuit board 104. In the illustrated embodiment, the openings 118 are circular, however the openings 118 may have other shapes in alternative embodiments. As described in further detail below, portions of the straddle mount connector 102 are received in the openings 118 to secure the straddle mount connector 102 to the circuit board 104.

The straddle mount connector 102 includes a housing 120 having a mating end 122 and a mounting end 124 opposite the mating end 122. The mating end 122 is configured for mating with a corresponding mating component 125. In the illustrated embodiment, the mating end 122 includes a slot 126 that is configured to receive a circuit card therein. The circuit card represents one type of mating component that may be used with the straddle mount connector 102. The circuit card may include contact pads proximate to an edge of the circuit card, where the edge is received in the slot 126. Other types of mating components may be used in alternative embodiments, such as a mating connector. The mating end 122 of the straddle mount connector 102 may be shaped differently for mating with different types of mating components.

The straddle mount connector 102 includes a plurality of power contacts 128 and a plurality of signal contacts 130. The straddle mount connector 102 may include other types of contacts in alternative embodiments, such as ground contacts. The straddle mount connector 102 may include only power contacts 128 or only signal contacts 130 in alternative embodiments. The power contacts 128 and signal contacts 130 are aligned with corresponding contact pads 112 in the contact region 116 when the straddle mount connector 102 is mounted to the circuit board 104.

The power contacts 128 and signal contacts 130 are held by the housing 120. The power contacts 128 and the signal contacts 130 extend from the mounting end 124 of the housing 120 for terminating to the contact pads 112 on the circuit board 104. The power contacts 128 and signal contacts 130 are cantilevered beyond the mounting end 124. In an exemplary embodiment, the power contacts 128 and the signal contacts 130 are soldered to the contact pads 112 to electrically and mechanically couple the power contacts 128 and signal contacts 130 to the contact pads 112.

The power contacts 128 and signal contacts 130 extend through the housing 120 and are arranged at the mating end 122 of the housing 120 for mating with the mating component. For example, ends of the power contacts 128 and signal contacts 130 are exposed within the slot 126 for mating with the circuit card when the circuit card is plugged into the slot 126. The housing 120 surrounds the power contacts 128 and the signal contacts 130 at mating ends thereof.

The housing 120 includes a top 132 and a bottom 134 opposite the top 132. The housing 120 extends between opposite left and right sides 136, 138. The housing 120 is elongated longitudinally between the left and right sides 136, 138 along a longitudinal axis 140. The longitudinal axis 140 extends along the longitudinal axis 114 of the mating edge 110 of the circuit board 104.

In an exemplary embodiment, the power contacts 128 and signal contacts 130 are arranged in both an upper row and a lower row, with the upper row proximate to the top 132 and the lower row proximate to the bottom 134. The power contacts 128 and the signal contacts 130 in the upper row engage contact pads 112 on the first surface 106. The power contacts 128 and the signal contacts 130 in the lower row engage contact pads 112 on the second surface 108. The power contacts 128 and the signal contacts 130 are also configured to engage contact pads on both an upper surface and a lower surface of the circuit card that is plugged into the slot 126. The power contacts 128 and signal contacts 130 are arranged along both an upper portion and a lower portion of the slot 126 and define a space therebetween that receives the circuit card between the upper and lower rows of the power contacts 128 and signal contacts 130.

The straddle mount connector 102 includes a plurality of mounting features that are used to secure the straddle mount connector 102 to the circuit board 104. The mounting features of the straddle mount connector 102 engage the openings 118 of the circuit board 104 to secure the straddle mount connector 102 to the circuit board 104.

In the illustrated embodiment, the straddle mount connector 102 includes a left side upper mounting feature 142, a left side lower mounting feature 144, a right side upper mounting feature 146 and a right side lower mounting feature 148. Any number of mounting features may be used in alternative embodiments. The mounting features 142-148 cooperate to secure the straddle mount connector 102 to the circuit board 104. The mounting features 142-148 directly engage the circuit board 104 to hold the straddle mount connector 102 in position on the circuit board 104 for soldering the power contacts 128 and/or the signal contacts 130 to the contact pads 112. The mounting features 142-148 are attached to the circuit board 104 without the need for additional mounting hardware, such as fasteners. The mounting features 142-148 may clamp to the circuit board 104 without the need for additional mounting hardware. The mounting features 142-148 hold the circuit board 104 between the left side upper and lower mounting features 142, 144 and between the right side upper and lower mounting features 146, 148. The left side upper and lower mounting features 142, 144 are received in a common opening 118 of the circuit board 104 and the right side upper and lower mounting features 146, 148 are received in a common opening 118 of the circuit board 104.

The left side upper mounting feature 142 extends from the mounting end 124 of the housing 120 proximate to the left side 136 of the housing 120. The mounting feature 142 includes an arm 150 having a base 152. The arm 150 extends to a distal end 154. The arm 150 has a convex portion 156 that extends into the opening 118 of the circuit board 104. The mounting feature 142 has a side 158 defining the longitudinally outermost portion of the straddle mount connector 102. In the illustrated embodiment, the base 152 extends outward from the left side 136 of the housing 120 and the arm 150 extends rearward from the base 152 to the distal end 154. The convex portion 156 is provided between the base 152 and the distal end 154. The convex portion 156 extends towards the circuit board 104. The convex portion 156 is the portion of the arm 150 that extends into the opening 118. With the convex portion 156 held within the opening 118, the straddle mount connector 102 is securely held to the circuit board 104. The convex portion 156 is shaped to fit in the opening 118 in a snug manner to resist movement of the straddle mount connector 102 with respect to the circuit board 104.

The left side lower mounting feature 144 extends from the mounting end 124 of the housing 120 proximate to the left side 136 of the housing 120. The mounting feature 144 includes an arm 160 having a base 162. The arm 160 extends to a distal end 164. The arm 160 has a convex portion 166 that extends into the opening 118 of the circuit board 104. The mounting feature 144 has a side 168 defining the longitudinally outermost portion of the straddle mount connector 102. In the illustrated embodiment, the base 162 extends outward from the left side 136 of the housing 120 and the arm 160 extends rearward from the base 162 to the distal end 164. The convex portion 166 is provided between the base 162 and the distal end 164. The convex portion 166 extends towards the circuit board 104. The convex portion 166 is the portion of the arm 160 that extends into the opening 118. With the convex portion 166 held within the opening 118, the straddle mount connector 102 is securely held to the circuit board 104. The convex portion 166 is shaped to fit in the opening 118 in a snug manner to resist movement of the straddle mount connector 102 with respect to the circuit board 104.

The right side upper mounting feature 146 extends from the mounting end 124 of the housing 120 proximate to the right side 138 of the housing 120. The mounting feature 146 includes an arm 170 having a base 172. The arm 170 extends to a distal end 174. The arm 170 has a convex portion 176 that extends into the opening 118 of the circuit board 104. The mounting feature 146 has a side 178 defining the longitudinally outermost portion of the straddle mount connector 102. In the illustrated embodiment, the base 172 extends outward from the right side 138 of the housing 120 and the arm 170 extends rearward from the base 172 to the distal end 174. The convex portion 176 is provided between the base 172 and the distal end 174. The convex portion 176 extends towards the circuit board 104. The convex portion 176 is the portion of the arm 170 that extends into the opening 118. With the convex portion 176 held within the opening 118, the straddle mount connector 102 is securely held to the circuit board 104. The convex portion 176 is shaped to fit in the opening in a snug manner to resist movement of the straddle mount connector 102 with respect to the circuit board 104.

The right side lower mounting feature 148 extends from the mounting end 124 of the housing 120 proximate to the right side 138 of the housing 120. The mounting feature 148 includes an arm 180 having a base 182. The arm 180 extends to a distal end 184. The arm 180 has a convex portion 186 that extends into the opening 118 of the circuit board 104. The mounting feature 148 has a side 188 defining the longitudinally outermost portion of the straddle mount connector 102. In the illustrated embodiment, the base 182 extends outward from the right side 138 of the housing 120 and the arm 180 extends rearward from the base 182 to the distal end 184. The convex portion 186 is provided between the base 182 and the distal end 184. The convex portion 186 extends towards the circuit board 104. The convex portion 186 is the portion of the arm 180 that extends into the opening 118. With the convex portion 186 held within the opening 118, the straddle mount connector 102 is securely held to the circuit board 104. The convex portion 186 is shaped to fit in the opening 118 in a snug manner to resist movement of the straddle mount connector 102 with respect to the circuit board 104.

The straddle mount connector 102 includes combs 190 extending from the mounting end 124 of the housing 120. One comb 190 extends from the housing 120 proximate to the top 132, defining an upper comb, while another comb 190 extends from the housing 120 proximate to the bottom 134, defining a lower comb. The combs 190 are arranged adjacent to and interspersed between the signal contacts 130. Each comb 190 includes a plurality of fingers 192 separated from one another by gaps 194. The comb 190 is positioned with respect to the signal contacts 130 such that the fingers 192 are positioned between corresponding signal contacts 130 and the signal contacts 130 are positioned within corresponding gaps 194. The fingers 192 electrically separate the signal contacts 130 from one another. The fingers 192 prevent bridging of solder paste on the contact pads 112 between adjacent contact pads 112. In an alternative embodiment, the straddle mount connector 102 may not include any combs. Rather, the signal contacts 130 may be positioned adjacent one another without fingers therebetween.

Figure 3:
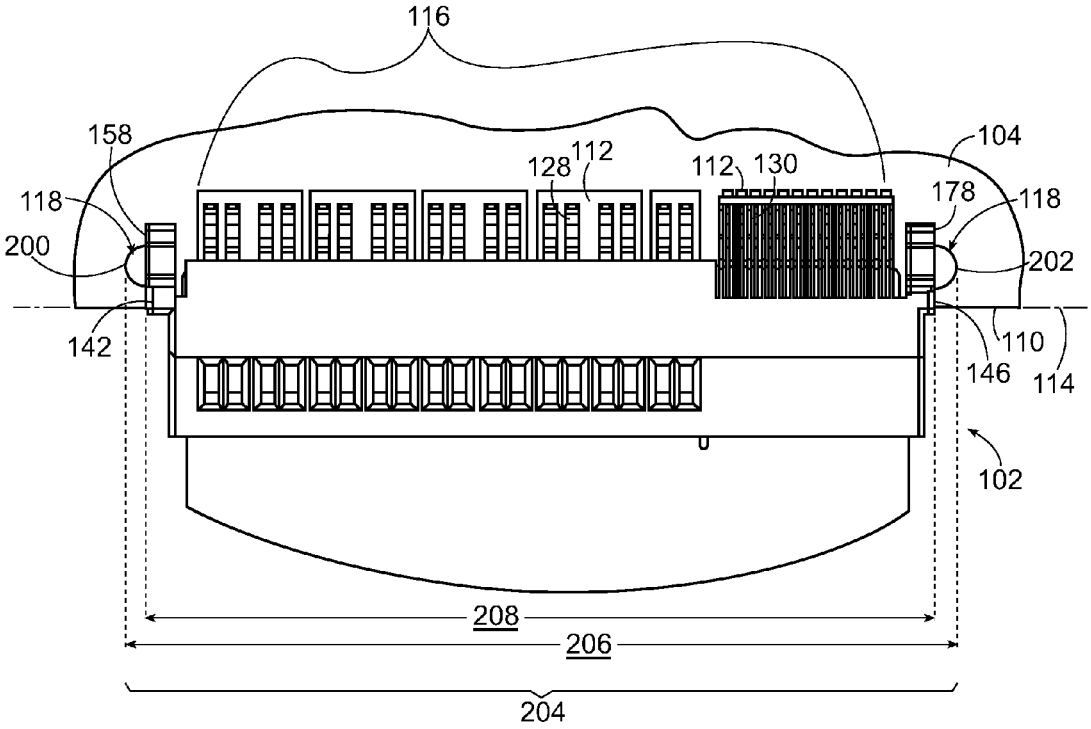
FIG. 3 is a top view of the straddle mount connector mounted to the circuit board.

FIG. 3 is a top view of the straddle mount connector 102 mounted to the circuit board 104. The straddle mount connector 102 is mounted to the mating edge 110 of the circuit board 104. The power contacts 128 engage corresponding contact pads 112. The signal contacts 130 engage corresponding contact pads 112. The power contacts 128 and signal contacts 130 may be soldered to the contact pads 112 after the straddle mount connector 102 is mounted to the circuit board 104. The power contacts 128 and signal contacts 130 are arranged within the contact region 116 between the opposite openings 118 on opposite-sides of the contact region 116.

The mounting features 142-148 (144 and 148 are shown in FIG. 1) engage the corresponding openings 118 of the circuit board 104 to hold the straddle mount connector 102 onto the circuit board 104. The openings 118 are longitudinally offset from the contact region 116 along the longitudinal axis 114. In the illustrated embodiment, the openings 118 are circular in shape, however the openings 118 may have other shapes in alternative embodiments, such as rectangular shapes. The openings 118 have longitudinally outermost points 200, 202.

A window 204 is defined between the longitudinally outermost points 200, 202 of the openings 118. The window 204 has a width 206 that defines a longitudinal envelope that receives the straddle mount connector 102. In an exemplary embodiment, the straddle mount connector 102 is coupled to the circuit board 104 such that no portion of the straddle mount connector 102 extends outside of the window 204. The straddle mount connector 102 is entirely contained within the envelope defined by the window 204.

The sides 158, 178 of the left side upper mounting feature 142 and the right side upper mounting feature 146, respectively, define the longitudinally outermost portions of the straddle mount connector 102. The straddle mount connector 102 has a width 208 defined between the sides 158, 178. In an exemplary embodiment, the width 208 is less than the width 206. The sides 158, 178 are held longitudinally inside of the longitudinally outermost points 200, 202 of the openings 118. Having the width 208 less than the width 206 allows other electrical components to be mounted on the circuit board 104 closer to the contact region 116 than if the width 208 was wider than the width 206.

Optionally, a second straddle mount connector (not shown) may be mounted to the circuit board 104 adjacent the straddle mount connector 102. The second straddle mount connector may have mounting features that are received in the same opening 118 as the mounting feature 142 or the mounting feature 146. For example, the mounting feature 142 may fill less than half of the opening 118 on the left side and mounting feature 146 may fill less than half of the opening 118 on the right side. Identical straddle mount connectors may be mounted adjacent one another such that the mounting feature 142 of the straddle mount connector 102 is received in the same opening 118 as a mounting feature of the second straddle mount connector. Other types of electrical components other than straddle mount connectors may be mounted to the circuit board 104 adjacent the opening 118. Optionally, the other electrical components may be mounted immediately adjacent the longitudinally outermost points 200, 202 of the openings 118.

Figure 4:
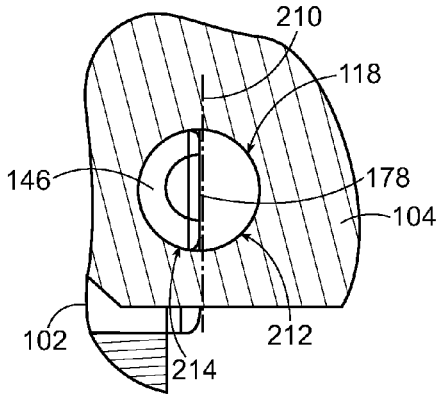
FIG. 4 is a bottom view of a portion of the straddle mount connector and the circuit board.
Figure 4A:
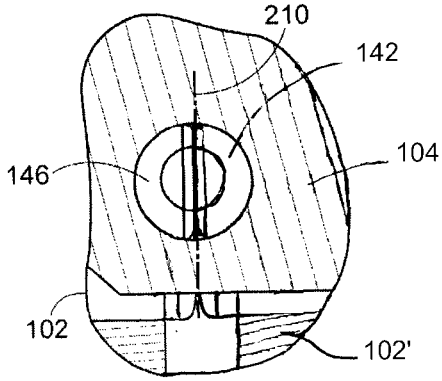
FIG. 4A is a bottom view of a portion of straddle mount connectors and the circuit board.

FIG. 4 is a bottom view of a portion of the straddle mount connector 102 and the circuit board 104 showing the mounting feature 146 received in the opening 118. The opening 118 is represented by a circular opening having a centerline 210 dividing the opening 118 into an outer portion 212 and an inner portion 214. Other shaped openings are possible in alternative embodiments, such as rectangular openings. The inner portion 214 is positioned between the outer portion 212 and the contact region 116 (shown in FIG. 3). The mounting feature 146 is received in the inner portion 214 such that the side 178 is positioned either at, or inside of, the centerline 210. As such, the mounting feature 146 fills less than half the opening 118. Another electrical component, such as a second straddle mount connector may be mounted to the circuit board 104 such that a mounting feature of such electrical component is also received within the opening 118 in the outer portion 212. For example, FIG. 4A illustrates a second straddle mount connector 102' mounted to the circuit board 104 such that a mounting feature 142 of the second straddle mount connector 102' is also received in the opening 118. In the illustrated embodiment, the portion of the mounting feature 146 received in the opening 118 is semi-circular in shape. Other shapes are possible in alternative embodiments.

Figure 5:
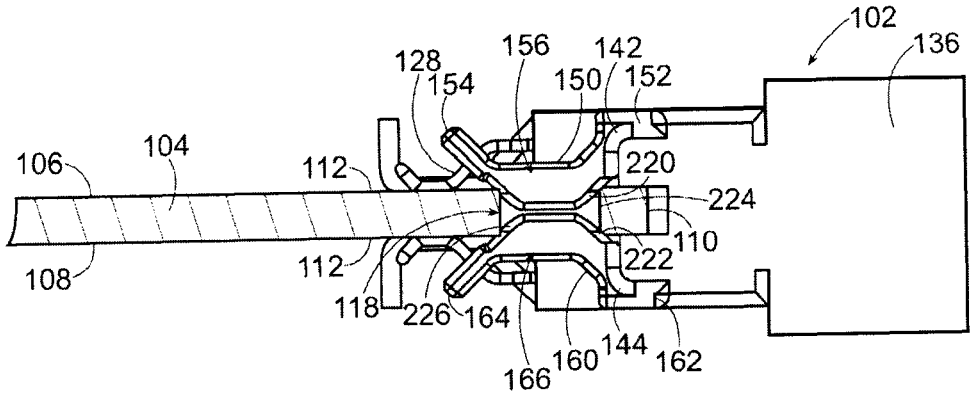
FIG. 5 is a cross-sectional view of the straddle mount connector mounted to the circuit board.

FIG. 5 is a cross-sectional view of the straddle mount connector 102 mounted to the circuit board 104. The left side 136 of the straddle mount connector 102 is shown in FIG. 5. The left side upper mounting feature 142 and the left side lower mounting feature 144 are received in the opening 118. The upper and lower mounting features 142, 144 both engage the circuit board 104 to hold the straddle mount connector 102 on the circuit board 104. When the straddle mount connector 102 is mounted to the circuit board 104, the power contacts 128 and signal contacts 130 (shown in FIG. 1) are coupled to corresponding contact pads 112 on both the first surface 106 and the second surface 108 of the circuit board 104.

During mounting of the straddle mount connector 102 to the circuit board 104, the upper and lower mounting features 142, 144 are spread apart and deflected outward by the mating edge 110 of the circuit board 104. The arm 150 may be deflected outward by rotating the distal end 154 in a clockwise direction about the base 152. The arm 160 may be deflected by rotating the distal end 164 in a counter-clockwise direction about the base 162. The arms 150, 160 may be spread apart to allow the circuit board 104 to pass therebetween. Once the convex portions 156, 166 are aligned with the opening 118, the convex portions 156, 166 drop into the opening 118 to hold the straddle mount connector 102 on the circuit board 104. The straddle mount connector 102 is loaded onto the mating edge 110 until the upper and lower mounting features 142, 144 are aligned with, and received in, the opening 118.

The convex portions 156, 166 are curved toward one another. The arm 150 includes an interior portion 220 that extends into the opening 118. Similarly, the arm 160 includes an interior portion 222 that extends into the opening 118. The interior portions 220, 222 are positioned interior of the first and second surfaces 106, 108, respectively. The distal ends 154, 164 extend rearward from the convex portions 156, 166 and are positioned outside of the opening 118.

Figure 5A:
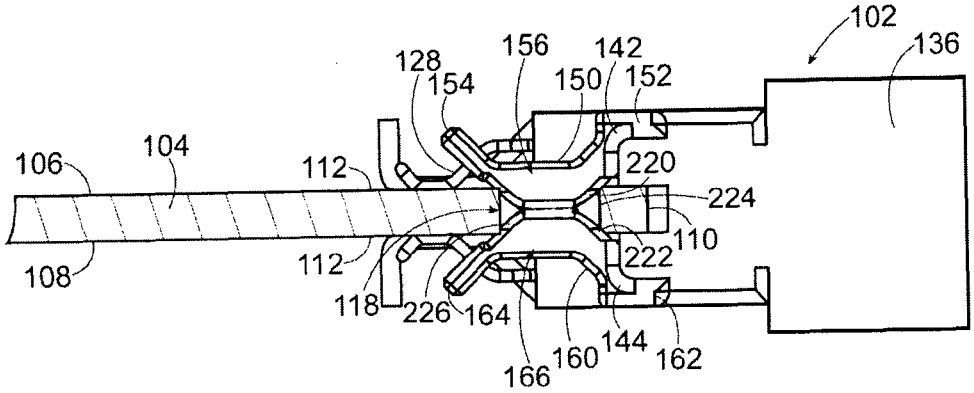
FIG. 5A is a cross-sectional view of the straddle mount connector mounted to the circuit board.

When assembled, the upper and lower mounting features 142, 144 clamp the circuit board 104 therebetween. The upper mounting feature 142 provides a downward biasing force against the circuit board 104. The lower mounting feature 144 provides an upward biasing force against the circuit board 104. Optionally, as shown in FIG. 5A, the upper and lower mounting features 142, 144 may engage one another within the opening 118. The upper and lower mounting features 142, 144 may be secured to one another, such as using an adhesive on one or both of the upper and lower mounting features 142, 144. Alternatively, the upper and lower mounting features 142, 144 may be secured to one another using other securing means, such as a fastener passing through the convex portions 156, 166.

In an exemplary embodiment, the upper and lower mounting features 142, 144 engage a front 224 of the opening 118 and a rear 226 of the opening 118. The interface between the mounting features 142, 144 and the front 224 prevents the straddle mount connector 102 from being moved forward with respect to the circuit board 104. The interface between the mounting features 142, 144 and the rear 226 prevents the straddle mount connector 102 from moving rearward with respect to the circuit board 104. The mounting, features 142, 144 thus hold the straddle mount connector 102 in position with respect to the circuit board 104 such that the power contacts 128 and signal contacts 130 may be soldered to the contact pads 112.

Figure 6:
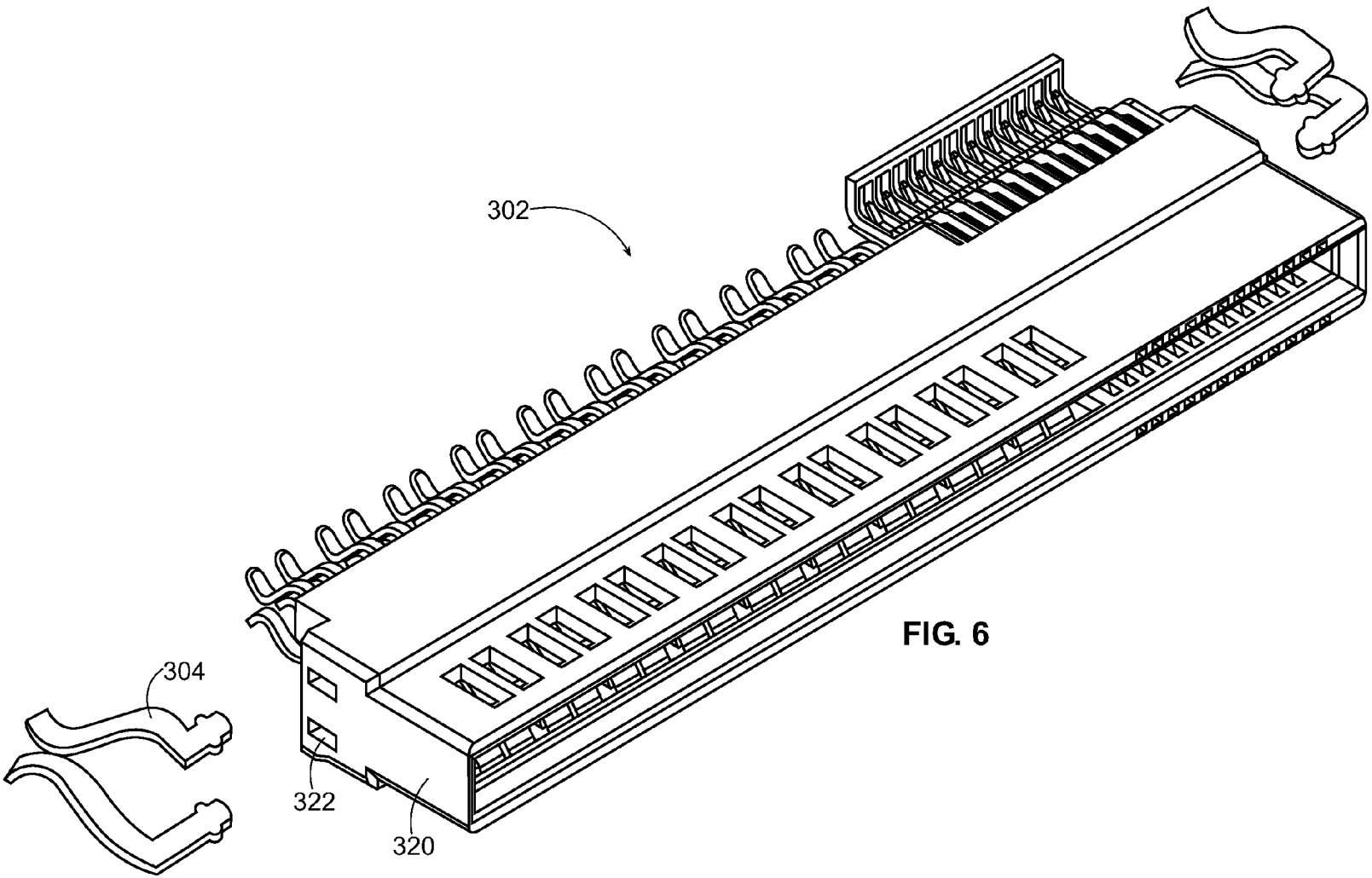
FIG. 6 illustrates an alternative straddle mount connector formed in accordance with an alternative embodiment.

FIG. 6 illustrates an alternative straddle mount connector 302 formed in accordance with an alternative embodiment. The straddle mount connector 302 is similar to the straddle mount connector 102 (shown in FIG. 1), however, the straddle mount connector 302 includes mounting features 304 that differ from the mounting features 142, 144, 146, 148 (shown in FIGS. 1 and 2).

The mounting features 304 are separate and discrete from a housing 320 of the straddle mount connector 302. The mounting features 304 are securely coupled to the housing 320. Optionally, the mounting features 304 may be manufactured from a different material than the housing 320. For example, the housing 320 may be fabricated from a dielectric material, such as a plastic material. The mounting features 304 may be fabricated from a metal material. The mounting features 304 may be manufactured from a material having a high spring characteristic that allow the mounting features 304 to be spring biased against the circuit board 104 (shown in FIGS. 1 and 2). The mounting features 304 provide a high clamping force therebetween to hold the straddle mount connector 302 in position with respect to the circuit board 104.

The straddle mount connector 302 is assembled by coupling the mounting features 304 to the housing 320. For example, the mounting features 304 may be loaded into openings 322 in the housing 320 and secured thereto by an interference fit between the mounting features 304 and housing 320. The straddle mount connector 302 is then mounted to the circuit board 104 in a similar manner as the straddle mount connector 102. The mounting features 304 are configured to be received in the openings 118 (shown in FIGS. 1 and 2) of the circuit board 104 to secure the straddle mount connector 302 to the circuit board 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A straddle mount connector comprising:

a housing having a mating end and a mounting end configured to be mounted to an edge of a circuit board, the housing having a top and a bottom, the housing having a side extending between the mating end and the mounting end, the housing having an upper mounting feature extending from the mounting end at the side and proximate to the top, the housing having a lower mounting feature extending from the mounting end at the side and proximate to the bottom, the upper and lower mounting features having sides being positioned outside of the side of the housing, wherein at least one of the upper and lower mounting features defines the longitudinally outermost portion of the straddle mount connector, the upper and lower mounting features being configured to extend into an opening through the circuit board to secure the housing to the circuit board; and contacts held by the housing, the contacts extending from the mounting end and being configured to be terminated to both sides of the circuit board, the contacts being arranged at the mating end and being configured for mating with a corresponding mating component.

2. The straddle mount connector of claim 1, wherein the upper and lower mounting features extend from the mounting end exterior of the side.

3. The straddle mount connector of claim 1, wherein the upper mounting feature provides a downward biasing force against the circuit board, the lower mounting feature provides an upward biasing force against the circuit board.

4. The straddle mount connector of claim 1, wherein the upper and lower mounting features engage one another within the opening.

5. The straddle mount connector of claim 1, wherein the upper mounting feature comprises an arm extending from the mounting end of the housing, the arm being deflectable, an interior portion of the arm extending into the opening, a distal end of the arm being outside of the opening.

6. The straddle mount connector of claim 1, wherein the upper mounting feature comprises an arm extending from the mounting end of housing, the arm having a convex portion extending into the opening.

7. The straddle mount connector of claim 1, wherein the side is a left side of the housing, the upper and lower mounting features are arranged at the left side of the housing and define left side upper and lower mounting features, respectively, the housing further comprising right side upper and lower mounting features configured to extend into a second opening in the circuit board to secure the housing to the circuit board.

8. The straddle mount connector of claim 7, wherein the circuit board defines a window between longitudinally outermost points of the first opening and second opening, the window having a width, the housing having a width defined between outer sides of the left side upper and lower mounting features and the right side upper and lower mounting features, the width of the housing being less than the width of the window.

9. The straddle mount connector of claim 1, wherein the upper and lower mounting features are separate and discrete from the housing and are coupled to the housing.

10. A connector system comprising:

a circuit board having a first surface and a second surface with pads on at least one of the first or second surfaces proximate to an edge of the circuit board, the edge extending in a longitudinal direction, the pads defining a contact region of the circuit board, the circuit board having an opening extending therethrough, the opening being longitudinally offset from the contact region; and a straddle mount connector mounted to the edge of the circuit board, the straddle mount connector comprising:

a housing having a mating end and a mounting end configured to be mounted to the edge of a circuit board, the housing being elongated between opposite right and left sides in a longitudinal direction parallel to the mounting end, the housing having a mounting feature extending from the mounting end at the right side, the mounting feature being configured to extend into the opening through the circuit board to secure the housing to the circuit board, the mounting feature having a side being positioned outside of the right side of the housing thereby defining the longitudinally outermost portion of the straddle mount connector, the side being positioned inside of a longitudinally outermost point of the opening; and contacts held by the housing, the contacts extending from the mounting end and being configured to be terminated to the pads on at least one of the first or second sides of the circuit board, the contacts being arranged at the mating end and being configured for mating with a corresponding mating component.

11. The connector system of claim 10, wherein no portion of the straddle mount connector extends longitudinally outside of the longitudinally outermost point of the opening.

12. The connector system of claim 10, wherein the side of the mounting feature is offset inward of the longitudinally outermost point of the opening.

13. The connector system of claim 10, wherein the opening has a centerline dividing the opening into an outer portion and an inner portion, the inner portion being positioned between the outer portion and the contact region, the mounting feature being received in the inner portion such that the side of the mounting feature is positioned either at or inside of the centerline.

14. The connector system of claim 10, wherein the opening is configured to receive another mounting feature of a second straddle mount connector such that the mounting feature of the second straddle mount connector is positioned adjacent to the side of the mounting feature of the straddle mount connector.

15. The connector system of claim 10, wherein the mounting feature constitutes an upper mounting feature, the housing further comprising a lower mounting feature extending from the mounting end at the right side of the housing, the lower mounting feature extending into the opening in the circuit board to secure the housing to the circuit board, the upper and lower mounting features clamping the circuit board therebetween.

16. The connector system of claim 10, wherein the circuit board further comprises a second opening on an opposite side of the contact region, a window being defined between the longitudinally outermost point of the opening and a longitudinally outermost point of the second opening, the window having a width, the straddle mount connector having a width less than the width of the window, the straddle mount connector having a second mounting feature extending from the left side of the housing, the second mounting feature being received in the second opening, the straddle mount connector contained entirely within the window.

17. A connector system comprising:

a circuit board having a first surface and a second surface with pads on the first and second surfaces proximate to an edge of the circuit board, the pads defining a contact region of the circuit board, the circuit board having an opening extending therethrough, the opening having a centerline dividing the opening into an outer portion and an inner portion, the inner portion being positioned between the outer portion and the contact region; and a straddle mount connector mounted to the edge of the circuit board, the straddle mount connector comprising:

a housing having a mating end and a mounting end configured to be mounted to the edge of a circuit board, the housing having an exterior side extending between the mating end and the mounting end, the housing having a mounting feature extending from the mounting end at the exterior side, the mounting feature having a side being positioned outside of the exterior side of the housing thereby defining the longitudinally outermost portion of the straddle mount connector, the mounting feature being configured to extend into the inner portion of the opening through the circuit board to secure the housing to the circuit board; and contacts held by the housing, the contacts extending from the mounting end and being configured to be terminated to the pads on both sides of the circuit board, the contacts being arranged at the mating end and being configured for mating with a corresponding mating component.

18. The connector system of claim 17, wherein the mounting feature is positioned entirely within the inner portion and does not extend into the outer portion.

19. The connector system of claim 17, wherein an outermost side of the mounting feature is positioned either at or inside of the centerline.

20. The connector system of claim 17, wherein the circuit board comprises a second opening on an opposite side of the contact region, a window being defined between a longitudinally outermost point of the opening and a longitudinally outermost point of the second opening, the window having a width, the straddle mount connector having a width less than width of the window, the straddle mount connector having a second mounting feature extending from a second exterior side of the housing that is opposite the other exterior side, the second mounting feature being received in the second opening, the straddle mount connector being contained entirely within the window.

* * * * *